US006677902B2

(12) United States Patent
Akiyama et al.

(10) Patent No.: US 6,677,902 B2
(45) Date of Patent: Jan. 13, 2004

(54) CIRCULARLY POLARIZED ANTENNA APPARATUS AND RADIO COMMUNICATION APPARATUS USING THE SAME

(75) Inventors: Hisashi Akiyama, Yokohama (JP); Kazunari Kawahata, Machida (JP); Shigehazu Ito, Ishikawa-ken (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 10/156,861

(22) Filed: May 30, 2002

(65) Prior Publication Data

US 2003/0058175 A1 Mar. 27, 2003

(30) Foreign Application Priority Data

Jun. 15, 2001 (JP) ..... 2001-182077

(51) Int. Cl.[7] ..... H01Q 1/38; H01Q 1/24
(52) U.S. Cl. ..... 343/700 MS; 343/702
(58) Field of Search ..... 343/700 MS, 702, 343/846, 848, 873; H01Q 1/38, 1/24

(56) References Cited

U.S. PATENT DOCUMENTS 5,200,756 A 4/1993 Feller
5,703,601 A 12/1997 Nalbandian et al.
6,201,502 B1 * 3/2001 Kurita et al. ..... 343/702

FOREIGN PATENT DOCUMENTS

EP 0 993 069 A2 4/2000
GB 2 359 929 A 9/2001

* cited by examiner

*Primary Examiner*—Hoanganh Le
(74) *Attorney, Agent, or Firm*—Keating & Bennett, LLP

(57) ABSTRACT

A circularly polarized antenna apparatus includes a radiating electrode and a ground electrode which are provided on a dielectric substrate. A degeneracy-splitting elements is also provided on the substrate to cause two resonant currents split between degenerate modes to be excited in the radiating electrode. The radiating electrodes includes a primary radiating electrode on a principal surface of the substrate, and secondary radiating electrode on side surfaces of the substrate, thus increasing the area of the radiating electrode. Therefore, the conductor loss of the primary radiating electrode is reduced and the antenna gain is increased.

20 Claims, 6 Drawing Sheets

CIRCULARLY POLARIZED ANTENNA APPARATUS AND RADIO COMMUNICATION APPARATUS USING THE SAME

BACKGROUND OF THE INVENTION

1. Field of the Invention

The present invention relates to a circularly polarized antenna apparatus and a radio communication apparatus including the same.

2. Description of the Related Art

Recent radio communication apparatuses using circularly polarized waves, such as GPS (Global Positioning System) or DAB (Digital Audio Broadcast) systems, for use in mobile vehicles such as automobiles and ships, have incorporated a compact circularly polarized antenna apparatus, as described in Japanese Unexamined Patent Application Publication No. 2000-183637. This type of antenna apparatus is shown in FIG. 10.

In the antenna apparatus shown in FIG. 10, a rectangular radiating electrode 4 having degeneracy-splitting elements 3 is provided on a first principal surface 2 of a solid rectangular substrate 1, and a ground electrode (not shown) is provided on a second principal surface 5 of the substrate 1. A strip feeding electrode 7 is provided on a side surface 6 of the substrate 1 so as to extend to the first principal surface 2 from the second principal surface 5 of the substrate 1. Wide capacitor electrodes 8, which are connected to the ground electrode, are provided at both sides of the feeding electrode 7. These components define a more compact antenna apparatus.

In this antenna apparatus, the length of each edge of the radiating electrode 4 is equal to one half the effective wavelength $\lambda$, that is, $\lambda/2$, of an electromagnetic wave to be radiated. The leading edge of the feeding electrode 7 wraps around to the first principal surface 2 so as to face the center portion of one edge of the radiating electrode 4 with a gap therebetween, such that the feeding electrode 7 is capacitively coupled with the radiating electrode 4. The degeneracy-splitting elements 3 are formed by cutting out the opposing corners of the radiating electrode 4 along a diagonal such that there is a difference between the diagonal electrical lengths of the radiating electrode 4.

With this structure, when signal power is supplied to the feeding electrode 7, two resonant currents which are out of phase by 90° are excited along the perpendicular diagonals of the radiating electrode 4. The two resonant currents provide excitation sources from which two spatially perpendicular electromagnetic waves having different frequencies radiate in a direction that is perpendicular to the feeding electrode 7.

In the aforementioned antenna apparatus, in order to reduce the dimensions, the capacitance of the capacitor electrode 8 is increased, while the area of the radiating electrode 4 provided on the first principal surface 2 is reduced. As a result, inevitably, the two resonant currents excited in the radiating electrode 4 flow in the radiating electrode 4 having a small area. Thus, even if the signal power supplied to the feeding electrode 7 increases to provide a high electric field strength for the electromagnetic waves to be radiated, the conductor loss of the radiating electrode 4 increases, which leads to a decrease in antenna gain.

SUMMARY OF THE INVENTION

In order to overcome the problems described above, preferred embodiments of the present invention provide a compact circularly polarized antenna apparatus which achieves high antenna gain, and a radio communication apparatus including the novel circularly polarized antenna apparatus.

One preferred embodiment of the present invention provides a circularly polarized antenna apparatus including a dielectric or magnetic substrate having a first principal surface, a second principal surface, and side surfaces, a radiating electrode provided on the substrate, a ground electrode provided on the second principal surface of the substrate, a feeding element for feeding excitation power to the radiating electrode, and a degeneracy-splitting element which causes two resonant currents to be excited in the radiating electrode, the two resonant current being split between degenerate modes. The radiating electrode is defined by a primary radiating electrode and secondary radiating electrodes, the primary radiating electrode is provided on the first principal surface of the substrate, and the secondary radiating electrodes are provided on the side surfaces of the substrate so as to connect to the primary radiating electrode, each secondary radiating electrode having substantially the same width as the primary radiating electrode.

The radiating electrode extends from the first principal surface to the side surfaces, and the area of the radiating electrode is increased at least by the area of the secondary radiating electrodes compared to the case where the radiating electrode is provided only on the first principal surface. This elongates the paths of the two resonant currents excited in the radiating electrode, thereby reducing the conductor loss of the primary radiating electrode. Moreover, since the area of the radiating electrode is increased, the size of the substrate is reduced, thus providing a compact antenna apparatus.

The degeneracy-splitting elements allow a difference between the electrical lengths along diagonals of the radiating electrode including the secondary radiating electrodes, thus causing two resonant currents to be excited along diagonals of the radiating electrode when signal power is supplied to the radiating electrode from the feeding element. The length of each edge of the radiating electrode preferably is substantially one half the effective wavelength of an electromagnetic wave to be radiated, although the secondary radiating electrodes are provided on the side surfaces of the substrate. This causes the two resonant currents which are out of phase with each other by 90° to flow in a substantially perpendicular manner.

Accordingly, the radiating electrode is provided on a first principal surface and on side surfaces of the substrate, thus achieving a compact circularly polarized antenna apparatus having a greatly reduced conductor loss of the primary radiating electrode with an increase in antenna gain.

The substrate preferably has a substantially rectangular shape with a first principal surface, a second principal surface, and four side surfaces. The primary radiating electrode of the radiating electrode is provided on the first principal surface of the substrate, and the secondary radiating electrodes of the radiating electrode are provided on two opposing side surfaces of the substrate.

The radiating electrode extends from the first principal surface to the two side surfaces, and the area of the radiating electrode is increased by the area of the secondary radiating electrodes provided on the two side surfaces in addition to the primary radiating electrode provided on the first principal surface. This elongates the diagonal electrical paths from the corners of one side surface to the corners of the other side surface, thereby reducing the conductor loss of the primary radiating electrode from which electromagnetic waves primarily radiate. Moreover, while the secondary radiating electrodes are provided on two side surfaces of the substrate, no secondary radiating electrode is provided on the other side surfaces of the substrate, such that there is no influence on the electric field strength of an electromagnetic wave to be radiated.

Accordingly, the radiating electrode is provided on a first principal surface and on two opposing side surfaces of the substrate, thus increasing the length of the paths of the two resonant currents excited in the radiating electrode. The secondary radiating electrodes are provided only on the two opposing side surfaces, thus achieving a compact circularly polarized antenna apparatus without interfering with the radiation of electromagnetic waves.

The degeneracy-splitting element preferably includes two capacitor electrodes having different lengths on the side surface of the substrate on which each of the secondary radiating electrodes is provided, each capacitor electrode having one end connected to the ground electrode, the capacitor electrodes extending towards the corners of each secondary radiating electrode.

Since the gaps differ between the capacitor electrodes and the secondary radiating electrodes, the secondary radiating electrodes and the capacitor electrodes are capacitively coupled via the capacitance having different capacitance values, thus causing two resonant currents split between the degenerate modes to be excited in the radiating electrode. If the capacitor electrodes are provided on two opposing side surfaces on which the secondary radiating electrodes are provided, the capacitor electrodes in a diagonally opposing state with respect to the radiating electrode have the same length, thereby reliably achieving the split modes.

The capacitance on the side surfaces of the substrate on which the capacitor electrodes are provided generates electrical paths in which the resonant currents flow along diagonals of the radiating electrode. The resonant currents flow in the primary radiating electrode and the secondary radiating electrodes, that is, the paths of the resonant currents flowing in the radiating electrode are elongated, thereby reducing the conductor loss of the primary radiating electrode.

Accordingly, the secondary radiating electrodes and the capacitor electrodes are provided on the side surfaces of the substrate, thus causing resonant currents in the degeneracy-split modes to be excited in the radiating electrode. Therefore, the resonance conditions are adjusted depending upon the capacitance therebetween. The two resonant currents flow in the direction toward the capacitor electrodes, thus increasing the lengths of the paths of the resonant currents flowing in the radiating electrode.

The degeneracy-splitting element is preferably formed by cutting out the corners of the secondary radiating electrodes along a diagonal of the radiating electrode.

With this structure, the degeneracy-splitting element is defined depending upon the secondary radiating electrodes provided on the side surfaces of the substrate. Thus, two resonant currents having different frequencies are excited in the radiating electrode without a change in the area of the primary radiating electrode from which electromagnetic waves primarily radiate. Again, this allows the resonant currents to flow in the primary radiating electrode and the secondary radiating electrodes, thus reducing the conductor loss of the primary radiating electrode.

Accordingly, the degeneracy-splitting element is provided in the secondary radiating electrodes on the side surfaces of the substrate, thus not requiring a reduction in the area of the primary radiating electrode from which electromagnetic waves primarily radiate. Thus, the antenna gain is greater than that in an antenna apparatus in the related art having a radiating electrode provided on a first principal surface of the substrate.

The primary radiating electrode of the radiating electrode is preferably notched at both side edges thereof which extend to the secondary radiating electrodes.

Thus, the electrical lengths of the radiating electrode in the direction extending to the secondary radiating electrodes are increased. The diagonal electrical lengths of the radiating electrode vary depending upon the depth of the notched portions or the number of notched portions. Therefore, the resonant frequencies of the two resonant currents in the degeneracy-split modes can be readily adjusted by forming the notched portions as appropriate. The angle of the two resonant currents in the split modes can also be adjusted.

The notched portions increase the diagonal electrical lengths of the radiating electrode. In consideration of the electrical lengths, the capacitance between the secondary radiating electrodes and the capacitor electrodes can be reduced. The secondary radiating electrodes and the capacitor electrodes are printed with a large tolerance for printing variations, thus increasing the production yield of circular polarized antenna apparatuses.

The primary radiating electrode preferably includes a slit extending along a diagonal of the radiating electrode. This increases the diagonal electrical length of the radiating electrode in the longitudinal direction of the slit to greater than that in the direction that is perpendicular to the longitudinal direction of the slit. The electrical length in the direction that is perpendicular to the longitudinal direction of the slit can be adjusted by changing the length of the slit, such that the difference in frequency between the two resonant currents is adjusted. With the slit and the capacitor electrodes, two resonant currents are reliably split between the degenerate modes in the radiating electrode. With this structure, again, the capacitance between the secondary radiating electrodes and the capacitor electrodes is greatly reduced.

The feeding element is preferably a strip feeding electrode provided on one side surface of the substrate so as to extend from the second principal surface of the substrate towards the edge of one of the secondary radiating electrodes.

The leading edge of the feeding electrode is capacitively coupled with the edge of the secondary radiating electrode, or alternatively, may be directly connected to the edge of the secondary radiating electrode, thus providing a simplified structure. The feeding electrode can be printed together with the secondary radiating electrodes and the capacitor electrodes, thus reducing the number of production steps for the circularly polarized antenna apparatus. Furthermore, the feeding electrode can be directly provided on the substrate, such that the circularly polarized antenna apparatus is mounted on a circuit board in a radio communication apparatus using a surface mount technique.

The feeding element is preferably a feed line which is inserted through the substrate from the second principal surface and which is isolated from the ground electrode.

Accordingly, the radiating electrode is directly fed through a feed line inserted through the substrate, such that the feed point provides impedance matching between the radiating electrode and the feed line, thereby achieving an efficient supply of signal power. This requires no impedance matching circuit, and thus the feeding circuit structure is simplified.

In another preferred embodiment of the present invention, a radio communication apparatus includes a circuit board having a radio-frequency receiving circuit or a radio-frequency transmitting and receiving circuit. The circularly polarized antenna apparatus including any of the structures according to preferred embodiments described above is mounted on the circuit board, in which the feeding element is connected to the input terminal of the receiving circuit or the transmitting and receiving circuit.

The radio communication apparatus including a compact circularly polarized antenna apparatus having high antenna gain is capable of more remote communications with the same transmission power, and is more sensitive to reception signals to receive weaker radio waves than a radio communication apparatus in the related art. The radio communication apparatus including such a highly compact circularly polarized antenna apparatus is very compact.

Other feature, elements, characteristics and advantages of the present invention will become more apparent from the following detailed description of preferred embodiments of the present invention with reference to the attached drawings.

DETAILED DESCRIPTION OF PREFERRED EMBODIMENTS

Preferred embodiments of the present invention will now be described with reference to the drawings.

Figure 1A:
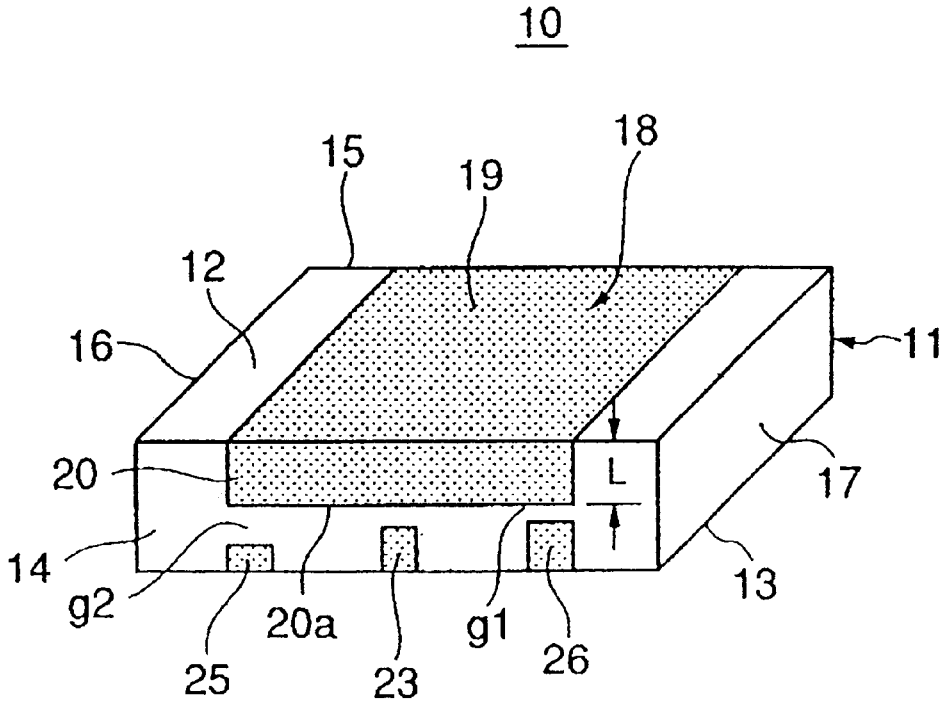
FIGS. 1A and 1B are a frontal perspective view and a rear perspective view of a circularly polarized antenna apparatus according to a preferred embodiment of the present invention, respectively.
Figure 1B:
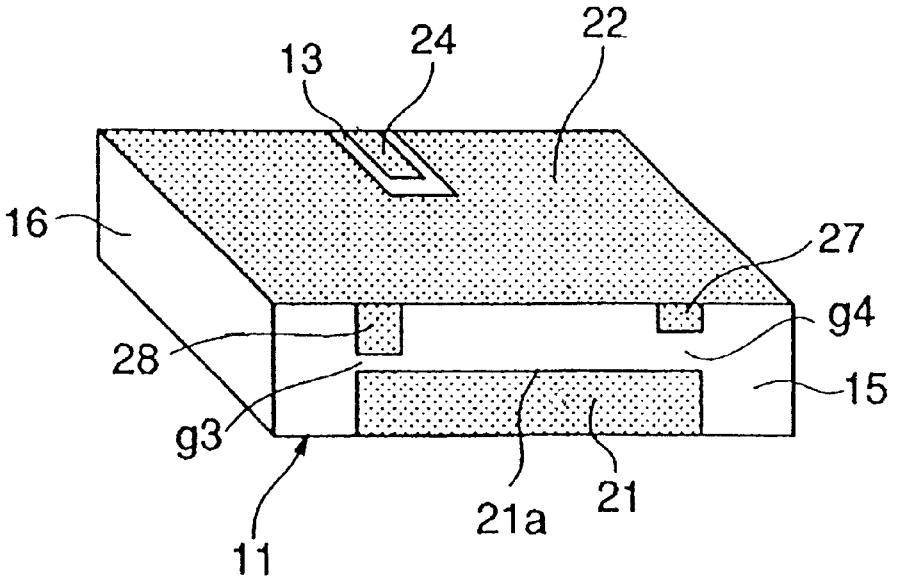

FIGS. 1A and 1B show a circularly polarized antenna apparatus 10 according to a preferred embodiment of the present invention.

In FIGS. 1A and 1B, the antenna apparatus 10 includes a substrate 11 having a substantially rectangular solid configuration. The substrate 11 is preferably made of a dielectric or magnetic material, such as ceramic or synthetic resin, and has a first principal surface 12, a second principal surface 13, and four side surfaces defined therebetween, namely, a front side surface 14, a rear side surface 15, a left side surface 16, and a right side surface 17.

A radiating electrode 18 is provided on the substrate 11. The radiating electrode 18 includes a primary radiating electrode 19 provided on the first principal surface 12, a secondary radiating electrode 20 provided on the front side surface 14, and a secondary radiating electrode 21 provided on the rear side surface 15. More specifically, the primary radiating electrode 19 is arranged so as to extend to the front and rear side surfaces 14 and 15 from the first principal surface 12 to define a primary radiating surface. The secondary electrodes 20 and 21 have substantially the same width as the primary radiating electrode 19, and connect to the primary radiating electrode 19 in such a manner that the radiating electrode 18 wraps around to the middle of the front and rear side surfaces 14 and 15 from the first principal surface 12. A ground electrode 22 is provided over the entire second principal surface 13 of the substrate 11 except in the vicinity of a feeding terminal described below.

A strip feeding electrode 23 is provided on the front side surface 14 of the substrate 11, extending from the second principal surface 13 to the first principal surface 12, in such a manner that the leading edge of the feeding electrode 23 faces the approximate center portion of a horizontal edge 20a of the secondary radiating electrode 20. The trailing edge of the feeding electrode 23 wraps around to the second principal surface 13 of the substrate 11 to define a feeding terminal 24. Strip capacitor electrodes 25 and 26, each having one end connected to the ground electrode 22, are provided on the front side surface 14 at both sides of the feeding electrode 23 with gaps therebetween, and extend towards the corners of the secondary radiating electrode 20.

The capacitor electrode 26 at the right-hand side of the feeding electrode 23 in FIG. 1A is longer than the capacitor electrode 25 at the left-hand side thereof, such that the gap g1 between the leading edge of the capacitor electrode 26 and the edge 20*a* of the secondary radiating electrode 20 is less than the gap g2 between the leading edge of the capacitor electrode 25 and the edge 20*a* of the secondary radiating electrode 20. This allows the capacitance in the gap g1 to be greater than the capacitance in the gap g2.

Likewise, strip capacitor electrodes 27 and 28 are provided on the rear side surface 15 of the substrate 11. The capacitor electrodes 25 and 27 which are in a diagonally opposing state with respect to the radiating electrode 18 have the same length, and the capacitor electrodes 26 and 28 which are in a diagonally opposing state have the same length, such that the gap g4 between an edge 21*a* of the secondary radiating electrode 21 and the leading edge of the capacitor electrode 27 is greater than the gap g3 between the edge 21*a* and the capacitor electrode 28. This allows the capacitance in the gap g4 to be less than the capacitance in the gap g3.

The radiating electrode 18 extends to the front and rear side surfaces 14 and 15 beyond the first principal surface 12 to increase the electrode area of the radiating electrode 18. This structure physically elongates the paths of the two resonant currents flowing in the radiating electrode 18, thereby reducing the conductor loss of the radiating electrode 18.

The capacitance along the diagonals of the radiating electrode 18 is such that the capacitance in the gaps g1 and g3 is greater than the capacitance in the gaps g2 and g4, resulting in a difference between the diagonal electrical lengths. This causes two resonant currents to be split between two diagonal degenerate modes to flow in the radiating electrode 18 when signal power is applied to the secondary radiating electrode 20 from the feeding electrode 23. The resonant currents have different frequencies according to the resonance conditions resulting from the difference between the electrical lengths, and serve as excitation sources of spatially perpendicular electromagnetic waves.

Figure 2:
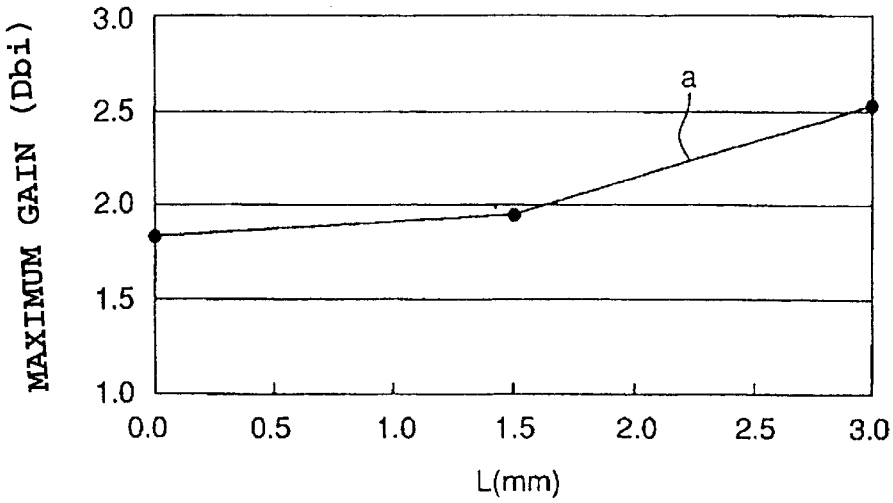
FIG. 2 is a characteristic view of the circularly polarized antenna apparatus shown in FIGS. 1A and 1B, showing the maximum antenna gain using the length of secondary radiating electrodes as a parameter.

FIG. 2 shows the results of an experiment. The substrate 11 used in the experiment was approximately 6 mm high, 12 mm wide, and 8 mm deep with a relative dielectric constant of about 90. The secondary radiating electrodes 20 and 21 were about 11 mm wide. The capacitor electrodes 25, 26, 27, and 28 were scaled depending upon the length L of the secondary radiating electrodes 20 and 21. In the experiment, the gaps g1, g2, g3, and g4 between the edges 20*a* and 21*a* of the secondary radiating electrodes 20 and 21, and the leading edges of the capacitor electrodes 25, 26, 27, and 28 were constant.

FIG. 2 depicts the maximum antenna gain (dBi) when the length L of the secondary radiating electrodes 20 and 21 in the height of the substrate 11 was approximately 0 mm, 1.5 mm, and 3 mm. Characteristic curve "all" shown in FIG. 2 shows that the maximum antenna gain increases as the length L of the secondary radiating electrodes 20 and 21 increases.

FIGS. 3A to 5 show a circularly polarized antenna apparatus according to another preferred embodiment of the present invention. In this preferred embodiment, degeneracy-splitting elements are provided in a radiating electrode. The same reference numerals are given to the same components in the preferred embodiment shown in FIGS. 1A and 1B, and a description thereof is omitted.

Figure 3A:
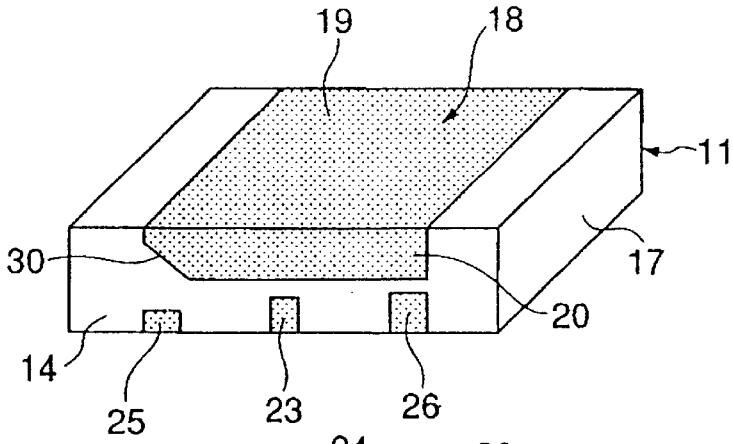
FIGS. 3A and 3B are a frontal perspective view and a rear perspective view of a circularly polarized antenna apparatus according to another preferred embodiment of the present invention, respectively.
Figure 3B:
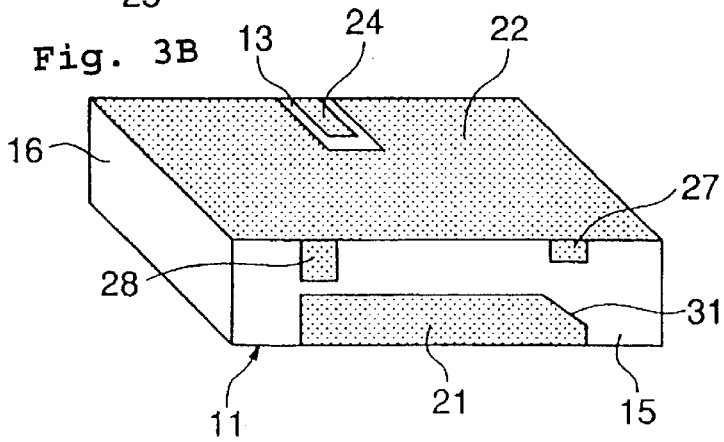

In FIGS. 3A and 3B, degeneracy-splitting elements 30 and 31 are provided by obliquely cutting out the corner of the secondary radiating electrode 20 in the radiating electrode 18 near the capacitor electrode 25 and the corner of the secondary radiating electrode 21 near the capacitor electrode 27, respectively. This makes the diagonal length between the degeneracy-splitting element 30 and the degeneracy-splitting element 31 of the radiating electrode 18 less than the diagonal length between the corner of the secondary radiating electrode 20 near the capacitor electrode 26 and the corner of the secondary radiating electrode 21 near the capacitor electrode 28 where no degeneracy-splitting element is provided.

A difference between the diagonal lengths causes two resonant current paths having different electrical lengths to be provided in the radiating electrode 18, such that two At resonant currents which are split between degenerate modes as signal power is supplied from the feeding electrode 23 are excited in the radiating electrode 18. The degeneracy-split modes reliably occur due to a degeneracy-splitting effect of the capacitor electrodes 25, 26, 27, and 28.

In this preferred embodiment, the degeneracy-splitting elements 30 and 31 are provided in the secondary radiating electrodes 20 and 21 on the side surfaces 14 and 15, respectively, while the area of the primary radiating element 19 is not change. Thus, the conductor loss of the primary radiating electrode 19 is greatly reduced.

When the degeneracy-splitting elements 30 and 31 in the secondary radiating electrodes 20 and 21 have a sufficient degeneracy-splitting effect, the capacitance between the secondary radiating electrodes 20 and 21 and the capacitor electrodes 25, 26, 27, and 28 is reduced, thereby providing weaker capacitive coupling between the radiating electrode 18 and the capacitor electrodes 25, 26, 27, and 28. This is achieved, for example, by providing a wider gap between the secondary radiating electrodes 20 and 21 and the capacitor electrodes 25, 26, 27, and 28, or by reducing the width of the capacitor electrodes 25, 26, 27, and 28.

Figure 4A:
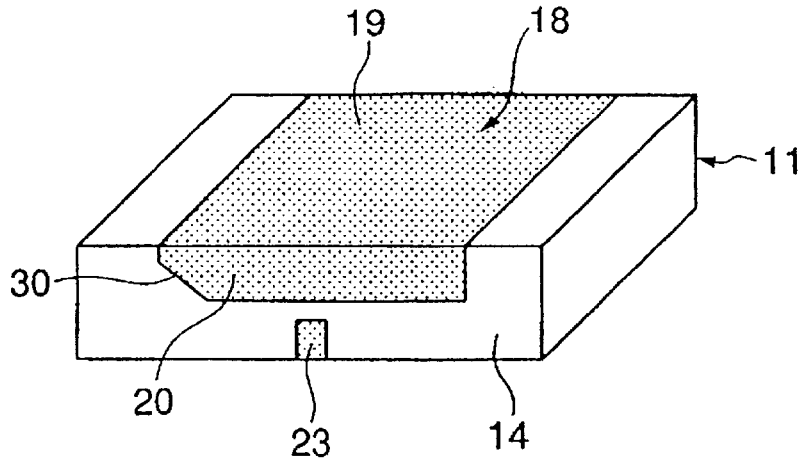
FIGS. 4A and 4B are a frontal perspective view and a rear perspective view of a circularly polarized antenna apparatus according to still another preferred embodiment of the present invention, respectively.
Figure 4B:
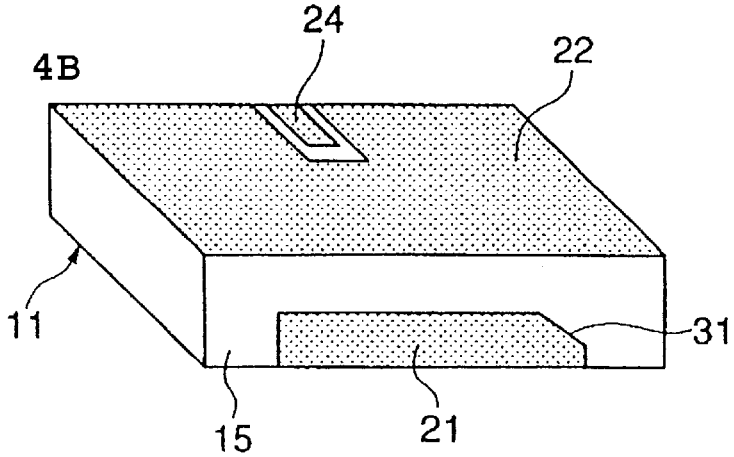

Furthermore, in view of the degeneracy-splitting effect of the degeneracy-splitting elements 30 and 31, as shown in FIGS. 4A and 4B, the capacitor electrodes 25, 26, 27, and 28 are removed from the side surfaces 14 and 15 of the substrate 11. In this structure, in order to reliably achieve the degeneracy-splitting effect of the degeneracy-splitting elements 30 and 31, the area of the secondary radiating electrodes 20 and 21 is increased in the downward direction with larger cutouts at the corners thereof, thereby strengthening the effect of the degeneracy-splitting elements 30 and 31. This greatly reduces the conductor loss of the primary radiating electrode 19.

Figure 5:
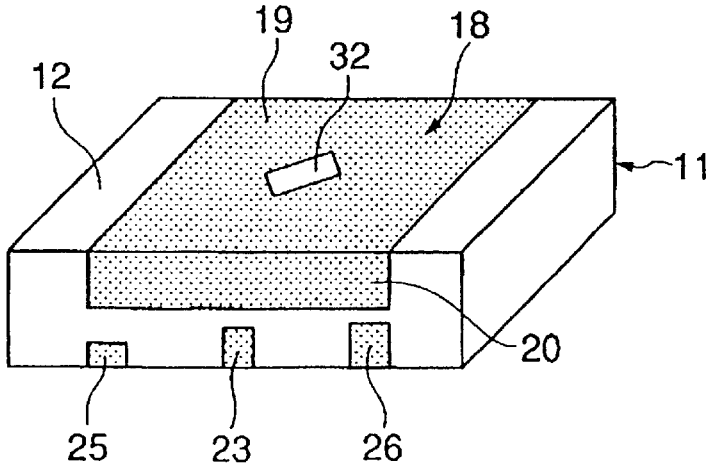
FIG. 5 is a frontal perspective view of a circularly polarized antenna apparatus according to still another preferred embodiment of the present invention.

In FIG. 5, a slit 32 is provided in the primary radiating electrode 19 so as to extend along a diagonal of the radiating element 18 extending between the corners of the secondary radiating electrodes 20 and 21 near the capacitor electrodes 25 and 27, respectively. With this structure, the electrical length of radiating electrode 18 in the longitudinal direction of the slit 32 is substantially the same as the electrical length in the case where the slit 32 is not provided, while the electrical length in the direction that is perpendicular to the longitudinal direction of the slit 32, that is, the electrical length along a diagonal extending between the corners of the secondary radiating electrodes 20 and 21 near the capacitor electrodes 26 and 28, respectively, is greater than the electrical length in the case where the slit 32 is not provided.

The difference between the two electrical lengths causes resonant currents in the degeneracy-split modes to be excited in the radiating electrode 18. The electrical length of the radiating element 18 in the direction that is perpendicular to the longitudinal direction of the slit 32 varies depending upon the length of the slit 32. Thus, by changing the length of the slit 32, the electrical length in the direction that is perpendicular to the longitudinal direction of the slit 32 can be adjusted with respect to the electrical length in the longitudinal direction of the slit 32. In other words, the difference in frequency between the two resonant currents is easily adjusted. The splitting of degenerate modes in the radiating electrode 18 is produced by superposing the degeneracy-splitting effect of the capacitor electrodes 25, 26, 27, and 28.

Figure 6:
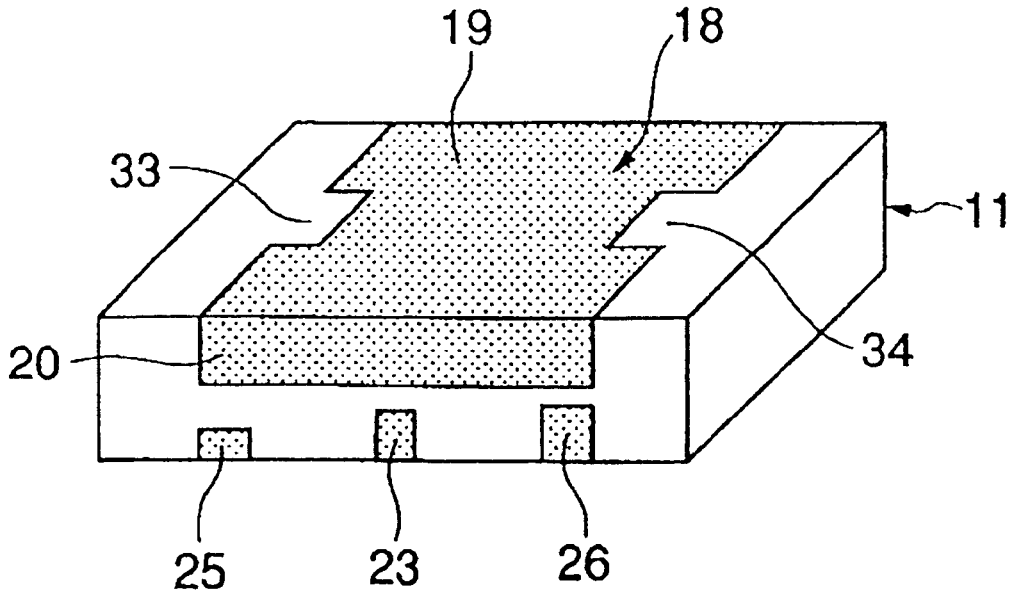
FIG. 6 is a frontal perspective view of a circularly polarized antenna apparatus according to still another preferred embodiment of the present invention.

FIG. 6 shows a circularly polarized antenna apparatus according to still another preferred embodiment of the present invention. The same reference numerals are given to the same components in the preferred embodiment shown in FIGS. 1A and 1B, and description thereof is omitted. In this preferred embodiment, cutout portions are provided in the primary radiating electrode 19.

In FIG. 6, the primary radiating electrode 19 provided on the first principal surface 12 is shallowly notched at both side edges to define cutout portions 33 and 34. That is, the cutout portions 33 and 34 allow the side edges of the radiating electrode 18 that extend to the secondary radiating electrodes 20 and 21 to be longer. This structure makes the two diagonal electrical lengths of the radiating electrode 18 longer, thereby changing the resonant frequencies of the two resonant currents.

The resonant frequencies of the two resonant currents split between the degenerate modes can be adjusted by appropriately setting the depth of the cutout portions 33 and 34 and the number of cutout portions. Since the width of the radiating electrode 18 does not change, the cutout portions 33 and 34 cause a change in angle of the two degenerate modes. This enables adjustment of the spatial angles of two electromagnetic waves radiating from the two resonant currents as excitation sources. The depth of the cutout portions 33 and 34, and the number of cutout portions at both side edges may differ. The cutout portions 33 and 34 may be used in combination with the degeneracy-splitting elements 30, 31, and 32.

Furthermore, since the cutout portions 33 and 34 increase the diagonal electrical lengths of the radiating electrode 18, the capacitance between the secondary radiating electrodes 20 and 21 and the capacitor electrodes 25, 26, 27, and 28 is greatly reduced. This also reduces the printing accuracy required for the secondary radiating electrodes 20 and 21 and the capacitor electrodes 25, 26, 27, and 28, thereby increasing the tolerance for printing variations. Therefore, the yield of circularly polarized antenna apparatuses in the production process is greatly increased.

Figure 7:
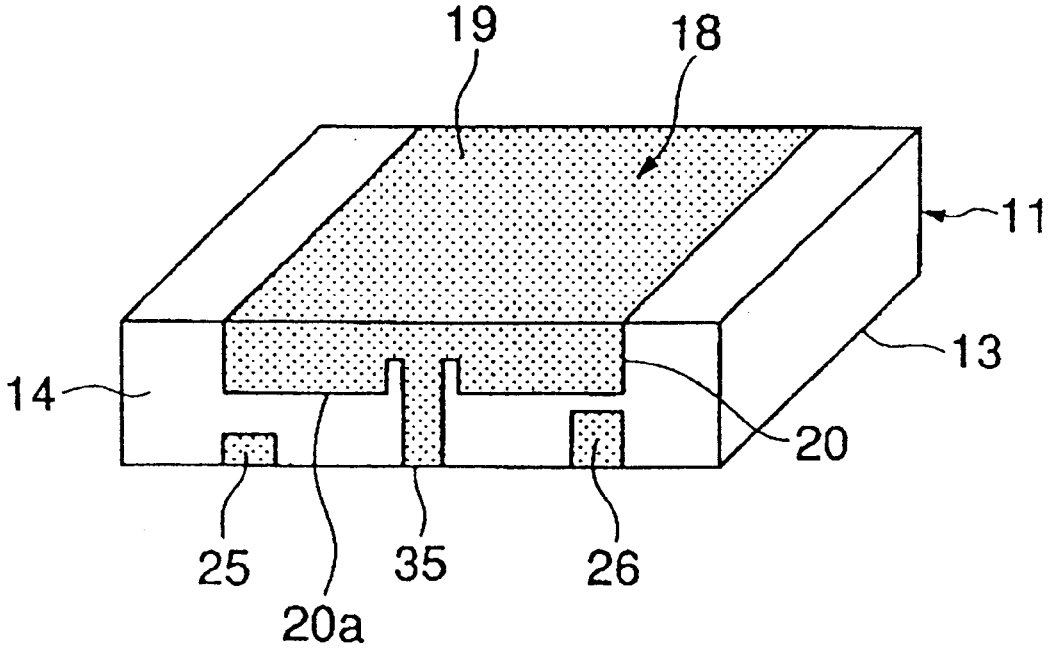
FIG. 7 is a frontal perspective view of a modified feeding element in the circularly polarized antenna apparatus according to preferred embodiments of the present invention.

In the aforementioned preferred embodiments, a capacitively fed antenna has been described in which the feeding electrode 23 is provided on the side surface 14 of the substrate 11 to feed signal power to the radiating electrode 18 in order to provide capacitive coupling between the feeding electrode 23 and the secondary radiating electrode 20. As shown in FIG. 7, however, a strip feeding electrode 35 that is directly connected to the secondary radiating electrode 20 may be provided on the side surface 14 of the substrate 11. This allows signal power to be directly fed to the radiating electrode 18 from the feeding electrode 35.

Figure 8:
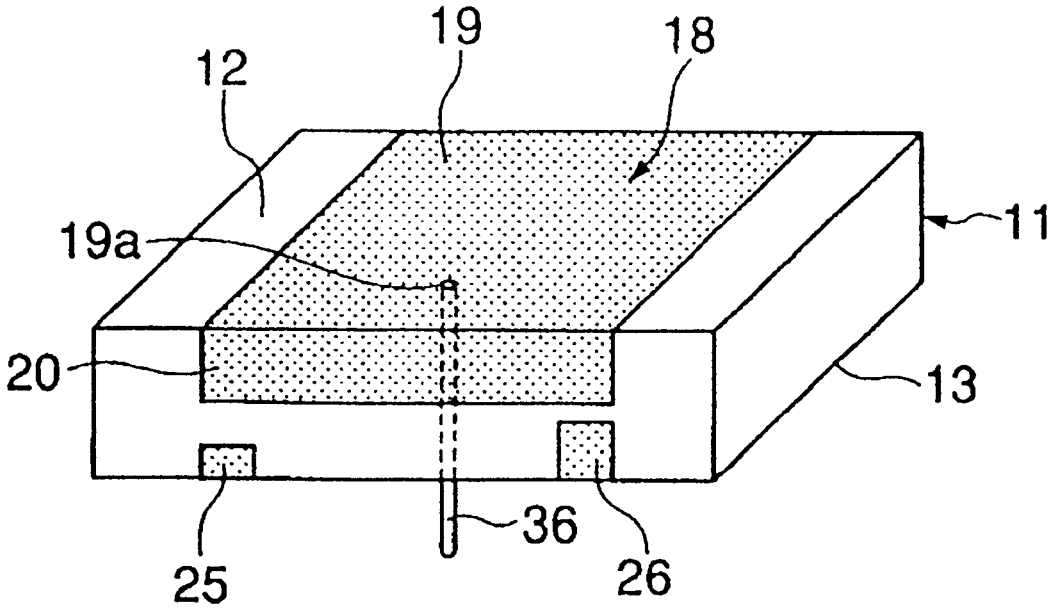
FIG. 8 is a frontal perspective view of another modified feeding element in the circularly polarized antenna apparatus according to preferred embodiments of the present invention.

Alternatively, as shown in FIG. 8, a feed line 36 may be inserted through the substrate 11 from the second principal surface 13 and connected to a feed point 19*a* so as to provide impedance matching between the radiating electrode 18 and the feed line 36. For example, where the impedance of the feed line 36 is 50 Ω, the feed point 19*a*, where the impedance of the radiating electrode 18 is 50 Ω, is fed, thus efficiently supplying signal power without an impedance matching circuit.

Figure 9:
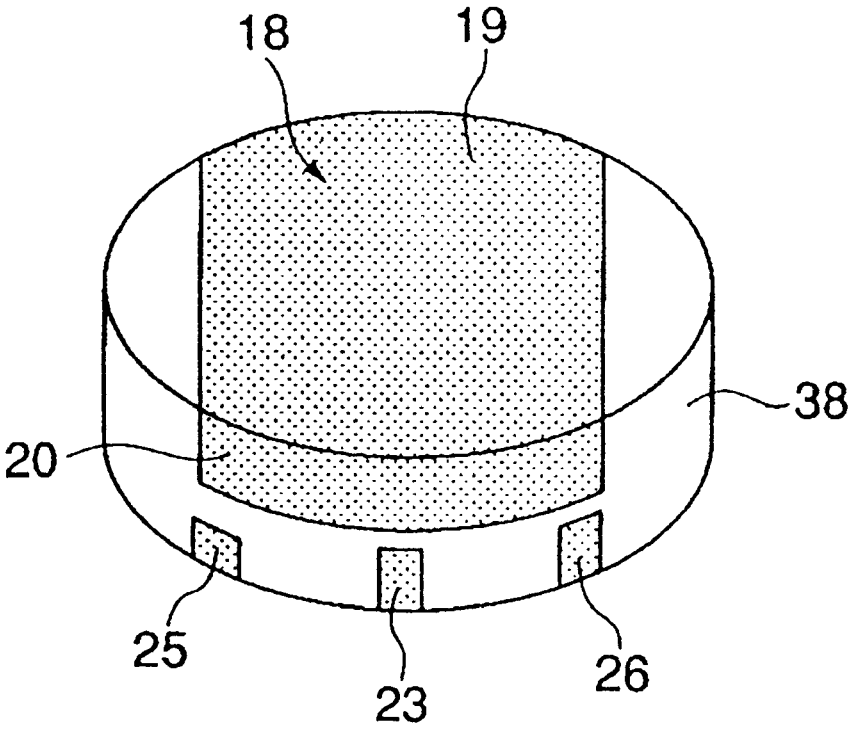
FIG. 9 is a frontal perspective view of a circularly polarized antenna apparatus according to still another preferred embodiment of the present invention.
Figure 10:
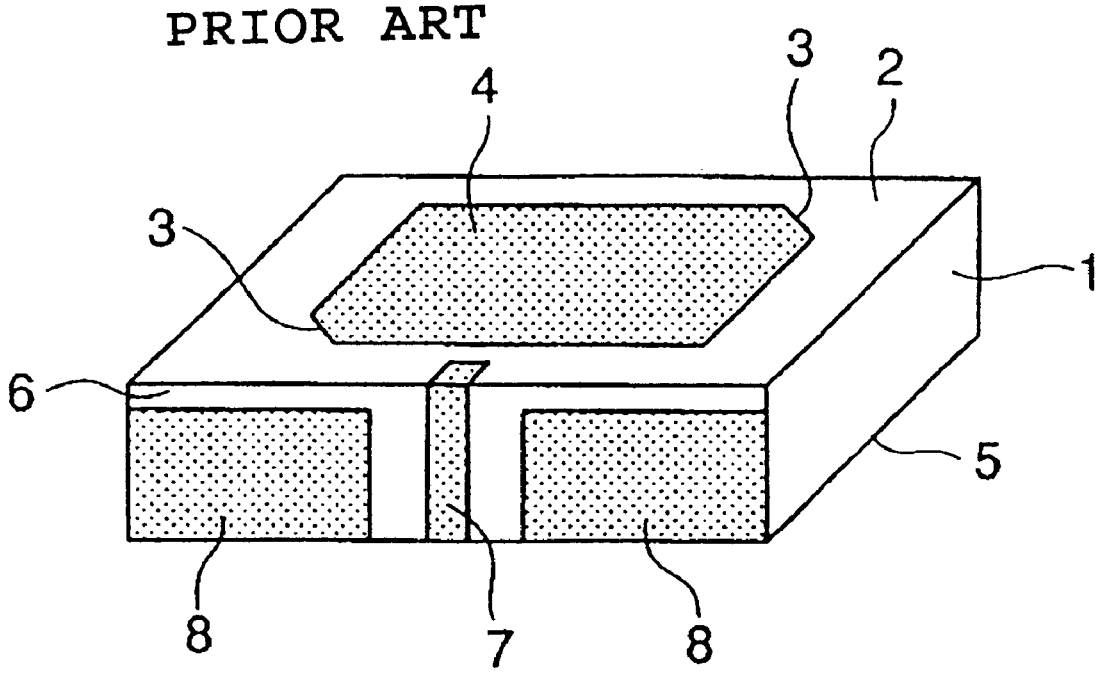
Fig. 10 PRIOR ART
FIG. 10 is a frontal perspective view of a circularly polarized antenna apparatus according to the related art.

While a solid, substantially rectangular substrate 11 is preferably used in the aforementioned preferred embodiments, a substantially cylindrical substrate 38 may also be used, as shown in FIG. 9. The substantially cylindrical substrate 38 may also increase the area of the radiating electrode 18, thus ensuring that the conductor loss of the primary radiating electrode 19 is reduced.

The circularly polarized antenna apparatus according to preferred embodiments of the present invention is compact, and therefore, may be directly incorporated onto a circuit board in a radio communication apparatus. The radio communication apparatus is used as a dedicated receiver in GPS, for example, or a transceiver in a portable terminal, for example, and includes a radio-frequency receiving circuit or transmitting/receiving circuit mounted on the circuit board. In this case, the feeding equipment 23, 35, and 36 of the circularly polarized antenna apparatus is connected to the input terminal of the receiving circuit or transmitting/receiving circuit, while the ground electrode 22 is connected to the ground layer.

While preferred embodiments of the invention have been described above, it is to be understood that variations and modifications will be apparent to those skilled in the art without departing the scope and spirit of the invention. The scope of the invention, therefore, is to be determined solely by the following claims.

What is claimed is:

1. A circularly polarized antenna apparatus comprising:

a dielectric or magnetic substrate having a first principal surface, a second principal surface, and side surfaces;

a radiating electrode provided on the substrate;

a ground electrode provided on the second principal surface of the substrate;

a feeding element for feeding excitation power to the radiating electrode; and a degeneracy-splitting element which causes two resonant currents to be excited in the radiating electrode, the two resonant current being split between degenerate modes; wherein the radiating electrode includes a primary radiating electrode and secondary radiating electrodes, the primary radiating electrode is provided on the first principal surface of the substrate, and the secondary radiating electrodes are provided on the side surfaces of the substrate so as to connect to the primary radiating electrode, each of the secondary radiating electrodes having substantially the same width as the primary radiating electrode.

2. A circularly polarized antenna apparatus according to claim 1, wherein the substrate is a substantially rectangular solid substrate, the primary radiating electrode of the radiating electrode is provided on the first principal surface of the substrate, and the secondary radiating electrodes of the radiating electrode are provided on two opposing side surfaces of the substrate.

3. A circularly polarized antenna apparatus according to claim 1, wherein the degeneracy-splitting element includes two capacitor electrodes having different lengths on the side surface of the substrate on which each of the secondary radiating electrodes is provided, each capacitor electrode having one end connected to the ground electrode, the capacitor electrodes extending towards corners of each secondary radiating electrode.

4. A circularly polarized antenna apparatus according to claim 1, wherein the degeneracy-splitting element is defined by cut-out corners of the secondary radiating electrodes extending along a diagonal of the radiating electrode.

5. A circularly polarized antenna apparatus according to claim 1, wherein the primary radiating electrode of the radiating electrode is notched at both side edges thereof which extend to the secondary radiating electrodes.

6. A circularly polarized antenna apparatus according to claim 1, wherein the primary radiating electrode includes a slit extending along a diagonal of the radiating electrode.

7. A circularly polarized antenna apparatus according to claim 1, wherein the feeding element includes a strip feeding electrode provided on one of the side surfaces of the substrate so as to extend from the second principal surface of the substrate towards the edge of one of the secondary radiating electrodes.

8. A circularly polarized antenna apparatus according to claim 1, wherein the feeding element includes a feed line which is inserted through the substrate from the second principal surface and which is isolated from the ground electrode.

9. A radio communication apparatus comprising:

a circuit board having a radio-frequency receiving circuit or a radio-frequency transmitting and receiving circuit; and the circularly polarized antenna apparatus according to claim 1, which is mounted on the circuit board, in which the feeding element is connected to the input terminal of the receiving circuit or the transmitting and receiving circuit.

10. A circularly polarized antenna apparatus comprising:

a substrate having a first principal surface, a second principal surface, and a plurality of side surfaces;

a radiating electrode including a primary radiating electrode provided on the first principal surface of the substrate, and secondary radiating electrodes connected to said primary radiating electrode and provided on at least two of said plurality of side surfaces of the substrate;

a ground electrode provided on the second principal surface of the substrate;

a feeding element for feeding excitation power to the radiating electrode; and a degeneracy-splitting element which causes two resonant currents to be excited in the radiating electrode, the two resonant current being split between degenerate modes; wherein each of said secondary radiating electrodes has substantially the same width as the primary radiating electrode.

11. A circular polarized antenna apparatus according to claim 10, wherein said substrate is a dielectric substrate.

12. A circular polarized antenna apparatus according to claim 10, wherein said substrate is a magnetic substrate.

13. A circularly polarized antenna apparatus according to claim 10, wherein the substrate is a substantially rectangular solid substrate the primary radiating electrode of the radiating electrode is provided on the first principal surface of the substrate, and the secondary radiating electrodes of the radiating electrode are provided on two opposing side surfaces of the substrate.

14. A circularly polarized antenna apparatus according to claim 10, wherein the degeneracy-splitting element includes two capacitor electrodes having different lengths on the side surface of the substrate on which each of the secondary radiating electrodes is provided, each capacitor electrode having one end connected to the ground electrode, the capacitor electrodes extending towards corners of each secondary radiating electrode.

15. A circularly polarized antenna apparatus according to claim 10, wherein the degeneracy-splitting element is defined by cut-out corners of the secondary radiating electrodes extending along a diagonal of the radiating electrode.

16. A circularly polarized antenna apparatus according to claim 10, wherein the primary radiating electrode of the radiating electrode is notched at both side edges thereof which extend to the secondary radiating electrodes.

17. A circularly polarized antenna apparatus according to claim 10, wherein the primary radiating electrode includes a slit extending along a diagonal of the radiating electrode.

18. A circularly polarized antenna apparatus according to claim 10, wherein the feeding element includes a strip feeding electrode provided on one side surface of the substrate so as to extend from the second principal surface of the substrate towards the edge of one of the secondary radiating electrodes.

19. A circularly polarized antenna apparatus according to claim 10, wherein the feeding element includes a feed line which is inserted through the substrate from the second principal surface and which is isolated from the ground electrode.

20. A radio communication apparatus comprising:

a circuit board having a radio-frequency receiving circuit or a radio-frequency transmitting and receiving circuit; and the circularly polarized antenna apparatus according to claim 10, which is mounted on the circuit board, in which the feeding element is connected to the input terminal of the receiving circuit or the transmitting and receiving circuit.

* * * * *